United States Patent [19]

Ling

[11] Patent Number: 4,622,076

[45] Date of Patent: Nov. 11, 1986

[54] METHOD FOR WASHING AN IMMUNOASSAY TRAY AND ITS APPARATUS

[75] Inventor: Chung-Mei Ling, Hsin Chu, Taiwan

[73] Assignee: General Biologicals Corp., Taiwan

[21] Appl. No.: 762,760

[22] Filed: Aug. 6, 1985

[51] Int. Cl.[4] ..... B08B 1/02

[52] U.S. Cl. ..... 134/32; 134/25.4; 134/117; 422/102; 436/531

[58] Field of Search ..... 134/39, 25.1, 25.4, 134/25.5, 32, 33, 34, 39, 117, 166 R; 436/531; 422/69, 71, 99, 105, 102; 8/152

[56] References Cited

U.S. PATENT DOCUMENTS

| | | | |
|---|---|---|---|
| 3,353,796 | 11/1967 | Roberts | 134/117 |
| 3,516,861 | 6/1970 | Menkes et al. | 134/25.4 |
| 4,078,943 | 4/1978 | Saurenman | 134/25.4 |
| 4,320,087 | 3/1982 | Chau et al. | 422/102 |
| 4,425,438 | 1/1984 | Bauman et al. | 436/531 |

*Primary Examiner*—Andrew H. Metz
*Assistant Examiner*—Sharon T. Cohen
*Attorney, Agent, or Firm*—Sughrue, Mion, Zinn, Macpeak and Seas

[57] ABSTRACT

A method for washing an assay tray includes the following steps. A solid pad of absorbent material, such as a layer of cotton sandwiched between a cardboard and a nonwoven fabric, is firstly placed over the wells of an assay tray. The assay tray is then tilted or inverted together with the pad to allow the serum to drain off and be absorbed in the pad. The assay tray is then inserted in a washing device and submerged in the stationary washing liquid. Subsequently, the washing device is moved relative to the washing liquid to let the washing liquid flow freely in and out of the wells of the assay tray to thoroughly wash the beads and the wells, while the beads will be blocked from falling out of the wells by means of the special design of the washing device. The washing device has a broad opened wall which confines a network of ribs formed by intersections of transverse and longitudinal walls. The intersecting portions substantially superimpose the center of the wells respectively. Each intersecting portion is of a size such that the beads will be blocked from falling out when the assay tray is inserted in the washing device, while the washing liquid flows freely in and out of the wells.

3 Claims, 6 Drawing Figures

METHOD FOR WASHING AN IMMUNOASSAY TRAY AND ITS APPARATUS

BACKGROUND OF THE INVENTION

The present invention relates to a method for washing an immunoassay tray, and particularly to a method for washing an immunoassay tray having beads in the wells.

A conventional washing device for use with diagnostic assays that utilize beads is designed to rinse beads in the wells separately, so as to avoid possible cross-contamination, this having been conceived as a problem by one skilled in the art if the beads in the wells have undergone different tests and are then subjected to rinsing in a common washing bath. Such kind of washing device as sold under trademark PENTAWASH II by Abbott Laboratories, North Chicago, Ill., U. S. A., includes five washing probes for separately rinsing five beads in five wells. By virtue of a set of suctioning apparatus, the rinsing water can be introduced into the well through each washing probe and subsequently aspirated out of the well. Although the washing device is sophisticated, its application in rinsing the beads and the wells still cannot eliminate the drawbacks of time consumption and high cost. This inventor has overcome the prejudice which has long existed in the art, and by dipping the assay tray in a common washing reservoir has discovered that no cross-contamination will occur during the rinsing of the wells and beads in the common washing reservoir.

SUMMARY OF THE INVENTION

It is an object of the present invention to provide a method for washing an assay tray in which the hazardous refuse can be easily disposed without seriously contaminating the environment.

It is another object of the present invention to provide a washing method which can easily and quickly wash the beads and the well of the assay tray.

It is a further object of the present invention to provide a washing device for implementing the above method effectively.

Accordingly, an assay tray which is intended to be washed by the present method and device, includes a tray body; a plurality of wells, normally the number of the wells being twenty, disposed in said tray body respectively in both transverse and longitudinal directions, and spaced at a predetermined distance from each other, and a plurality of beads, each bead being of a size such that said bead can be freely received in said corresponding well. The washing device includes a grip portion; a frame, connected with said grip, having a broad opened wall, and a groove disposed parallel to said broad opened wall for receiving the assay tray in such a manner that said wells and said beads face said broad opened wall; and a plurality of rib members confined by said broad opened wall and crisscrossing each other to form a plurality of intersecting portions which correspond to said wells respectively, each intersecting portion substantially superimposing said corresponding well and having a size such that the corresponding bead can be blocked from falling out of said well while the washing liquid can flow freely in and out of said well when the assay tray is received in said groove.

In accordance with one aspect of the present invention, a method for washing an assay tray comprises the steps of: placing a solid pad of absorbent material over the wells of an assay tray; inverting or tilting said assay tray together with said pad to drain off the liquid so as to allow it to be absorbed in the pad; submerging all the wells of said assay tray in a stationary washing liquid; and moving said assay tray relative to said washing liquid to rinse thoroughly the wells of the assay tray.

In accordance with another aspect of the present invention, a step is further included which screens the beads to block them from falling out of said wells of the assay tray before said assay tray is submerged in a stationary washing liquid.

The present exemplary preferred embodiments will be described in detail with reference to the drawings as follows:

DETAILED DESCRIPTION OF THE PREFERRED EMBODIMENTS

Figure 1:
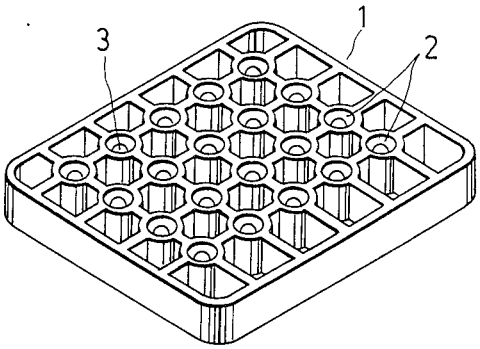
FIG. 1 is a perspective view of an assay tray for the immunoassay.
Figure 2:
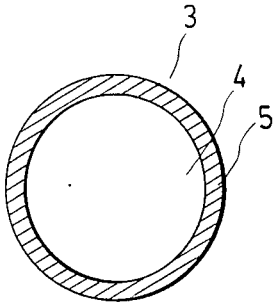
FIG. 2 is a sectional view of a bead of an assay tray.

Now referring to FIG. 1, there is shown a conventional assay tray 1 which is generally of a rectangular shape, and includes twenty wells 2 formed in four rows and five columns substantially at an equal distance from each other. The wells 2 are located respectively at the intersections formed by five transverse walls and four longitudinal walls crisscrossed with each other and substantially at an equal distance from each other. In each well, there is a detection bead 3 for determining qualitatively or quantitatively Hepatitis B Surface Antigen or its antibody in serum or plasma. The detection bead 3 is actually a bead 4 made of polystyrene or other plastic material on which a layer of Hepatitis B Surface Antibody or Antigen is coated.

Figure 3:
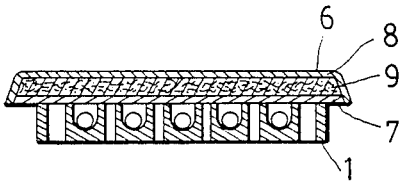
FIG. 3 illustrates a upright state in which a solid pad of absorbent material is placed over the wells of an assay tray.
Figure 4:
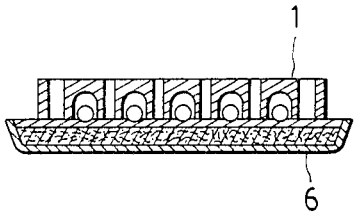
FIG. 4 illustrates a reversed state in which the state as shown in FIG. 3 is inverted.

Referring now to FIG. 3, there is shown an assay tray 1 covered by a solid pad of absorbent material 6 which is composed of an upper sheet of cardboard 7, a lower sheet of nonwoven fabric 8, and a cottom layer 9 interposed between the former two layers. The upper sheet of cardboard 7 in this instance contacts the upper surface of the assay tray 1. Due to the rather stiff quality of the cardboard 7, the assay tray 1 which is being covered with the solid pad 6 can easily be turned upside down to allow the serum which is to be examined to drain off and be absorbed by the pad 6. It can be clearly noted that the pad 6 can be used many times until the complete exhaustion of its absorbing capacity. In view of the fact that the waste pad is solid, there will be much less trouble involved in the disposal of such a kind of refuse, unlike the conventional method in which, after examination, the serum must be flushed with a great deal of water. Thus, the conventional method produces large quantities of contaminated waste water which is a difficult environmental problem.

Figure 6:
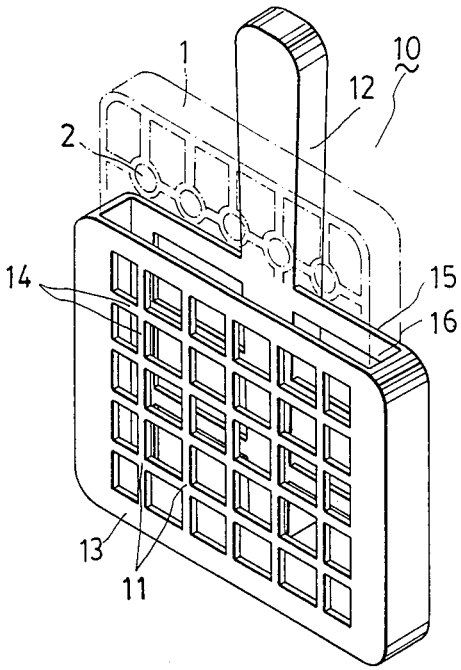
FIG. 6 illustrates how an assay tray, which is in phantom line, is inserted into a washing device according to the present invention.
Figure 5:
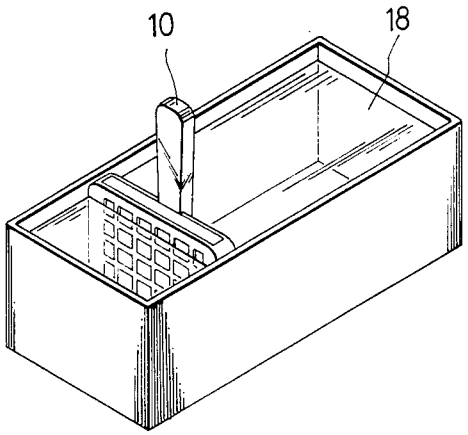
FIG. 5 illustrates a washing device incorporated with an assay tray being submerged in washing liquid.

Now referring to FIGS. 5 and 6, there is shown a washing device 10 which is suitable for implementing the present method. The washing device 10 includes a rectangular frame body 11 and a grip 12 substantially extending from a centerline of a first broad wall 15. The rectangular frame body 11 has a second broad opened wall 13 which is substantially parallel to the first wall 15 so as to form a groove or slot 16 for the insertion of the assay tray 1 as illustrated by the phantom line. The opened wall 13 confines a network of ribs 14 formed by the intersections 14' of longitudinal walls and transverse walls. The intersecting portions 14' substantially superimpose the centers of the wells 2 respectively. Each intersecting portion 14' has a size such that the bead 3 will be blocked from falling out of the well 2, while the washing liquid can flow freely in and out of the well 2 when the assay tray 1 is received in the groove 16 as shown in FIG. 5.

When washing the beads and the well, the pad 6 is firstly placed over the assay tray 1 to cover the wells which are filled with the blood to be examined. The assay tray 1, together with the pad 6 are then inverted to drain off the blood which is subsequently absorbed by the pad. The assay tray 1 is inserted in a horizontal direction into the slot 16 of the washing device 10, where each intersecting portion 14' superimposes the center of each well 2. As a result, when the washing device 10 with the inserted assay tray 1 is dipped into a common tank 18 of a stationary washing liquid, the bead in each well will be blocked from falling out of the well, while the washing liquid can freely be introduced into and flowed out of the wells during the moving of the washing device relative to the stationary washing liquid. The flow of the washing water relative to the washing device will rinse the beads and wells thoroughly without incurring any cross-contamination problem.

The present method will be explained in more detail by way of the following example.

EXAMPLE 1

A procedure of an enzymatic immunoassay is carried out to detect Hepatitis B Surface Antigen by utilizing an assay tray having twenty wells and beads.

1. Pipette 0.2 ml of a test sample into one reaction tray well. Pipette 0.2 ml of Negative Control into each of three designated reaction tray wells and 0.2 ml of Positive Control into two additional wells. The tray is then loosely covered with an adhesive cover seal and is stayed for 30 minutes. (Each well contains a bead properly coated with Hepatitis B Surface Antibody).

2. Lift the cover, add 0.1 ml antibody Horseradish peroxide into each well. Peel off the protective backing of the adhesive cover seal and use it to seal the wells.

3. Gently tap tray to ensure thorough mixing of the contents in the wells. The tray then is incubated in a water bath at 40° C. for two and a half hours.

4. Remove the cover seal and place an absorbent pad according to the present invention over the assay tray. The tray is inverted together with the pad to allow the liquid to drain off and be absorbed by the pad.

5. The tray is inserted into the groove of the washing device. The washing device is then dipped in a washing tank and is moved to and fro at least five times to rinse the wells thoroughly.

6. Color development and examination.

Method of determination by naked eye:

a. add 0.3 ml fresh prepared OPD solution.

b. Cover it and allow it to stay for 30 minutes.

c. Read the result with the help of color comparator.

Method of determination by instruments:

a. Transfer the bead to a test tube.

b. Add 0.3 ml fresh prepared OPD solution.

c. Cover it and allow it to stay for 30 minutes.

d. Add 1.0 ml 1N sulfuric acid solution to stop the reaction.

e. determine the result with a spectrophotometer.

EXAMPLE 2

A procedure of an radioimmunoassay is carried out to detect Hepatitis B Surface Antibody by utilizing an assay tray having twenty wells and beads.

1. Add 0.1 ml of $^{125}$I-HBsAg into each well containing a bead which is properly coated with Hepatitis B Surface Antigen.

2. Pipette 0.1 ml of a test sample into one reaction tray well. Pipette 0.1 ml of Negative Control into each of three designated reaction tray wells and 0.1 ml of Positive Control into two additional wells. The tray is then sealed with an adhesive cover seal and is stayed for 30 minutes.

3. Gently tap tray to ensure thorough mixing of the contents in the wells. The tray then is incubated in a water bath at 40° C. for two hours.

4. Remove the cover seal and place an absorbent pad according to the present invention over the assay tray. The tray is inverted together with the pad to allow the liquid to drain off and be absorbed by the pad.

5. Add 0.5 ml of deionized water into each well and repeat the procedure as set forth in step 4.

6. The tray is inserted into the groove of the washing device. The washing device is then dipped in a washing tank and is moved to and fro at least five times to rinse the wells thoroughly.

7. Transfer beads to properly identified assay tubes. Place the assay tubes in a suitable well type gamma scintillation counter and determine the results.

EXAMPLE 3

A procedure of an enzymatic immunoassay is carried out to detect Hepatitis B Antigen by utilizing an assay tray having ninety six wells.

1. Pipette 0.2 ml of a test sample into one reaction tray well. Pipette 0.2 ml of Negative Control into each of three designated reaction tray wells and 0.2 ml of Positive Control into two additional wells. The tray is then loosely covered with an adhesive cover seal and is stayed for 30 minutes. (Each well is properly coated with Hepatitis B Surface Antibody).

2. Lift the cover, add 0.1 ml Antibody Horseradish Peroxide into each well. Peel off the protective backing of the adhesive cover seal and use it to seal the wells.

3. Gently tap tray to ensure thorough mixing of the contents in the wells. the tray then is incubated in a water bath at 40° C. for two and a half hours.

4. Remove the cover seal and place an absorbent pad according to the present invention over the assay tray. The tray is inverted together with the pad to allow the liquid to drain off and be absorbed by the pad.

5. The tray is inserted into the groove of the washing device. The washing device is then dipped in a washing tank and is moved to and fro at least five times to rinse the wells thoroughly.

6. Color development and examination: Add 0.1 ml of fresh prepared OPD solution. Cover it and allow it to stay for one half hour. 0.1 ml of 2N sulfuric acid solution is added to stop the reaction. Determine the results by naked eye or spectrophotometer at the wavelength of 492 nm.

EXAMPLE 4

A procedure of a radioimmunassay is carried out to detect Hepatitis B Core Antibody by utilizing an assay tray having ninety six wells and beads.

1. Add respectively 0.1 ml of a test sample, three negative controls and two positive controls into each reaction well which is properly coated with Hepatitis B Core Antigen. In order to determine the results of each well separately, it is more convenient to use an assay tray the wells of which are capable of being detachably assembled.

2. Pipette 0.1 ml of $^{125}$I-Hepatitis B Core Antibody into the designated wells as mentioned above. Seal the wells with the adhesive cover seal and tap the tray to mix the liquid contents.

3. The tray then is incubated in a water bath at 40° C. for four hours or at room temperature for twenty hours.

4. Remove the cover seal and place an absorbent pad over the assay tray. The tray is inverted together with the pad to allow the liquid to drain off and be absorbed by the pad.

5. Add 0.3 ml of tap water into the reaction wells and repeat the step 4 to drain off the water.

6. The tray is inserted into the groove of the washing device. The washing device is then dipped in a washing tank and is moved to and fro at least five times to rinse the wells thoroughly.

7. Disengaging or cutting the tray to separate the wells. Place each well in a counting tube to be measured in a suitable well type gamma scintillation counter and determine the results.

While the invention has been described in connection with what is at present considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

I claim:

1. A method of cleaning an assay tray having reaction wells opening to one side of the tray receiving reaction beads respectfully, said method comprising the steps of:

placing a solid pad of absorbent material over said one side of said assay tray;

inverting the assay tray together with the pad to let the liquid contents in the wells be absorbed by the pad;

removing the tray from the pad and placing the assay tray carrying the reaction beads in a housing frame, having a network of intersecting ribs forming holes in a frame wall facing said wells with said networks of ribs extending over the reaction wells for the assay tray to screen the reaction beads in such a manner that the reaction beads are retained in the respective reaction wells;

submerging the housing frame in a wash-liquid; and agitating the wash-liquid relative to said tray to rinse thoroughly the wells of the assay tray.

2. A unitary, hand-held rectangular frame washing device for use in washing an assay tray of similar rectangular form having reaction wells opening to one side of the assay tray and receiving reaction beads respectively, said device comprising:

a rectangular housing frame for holding the assay tray, said frame having two broad, parallel walls spaced apart a distance slightly greater than the thickness of the assay tray, means defining an open slot at one edge of said rectangular frame for placement of said tray between said two parallel broad walls and at least the broad wall opposite the tray reaction wells being a perforated wall and having openings for the passage of washliquid therethrough, said openings being laterally offset from said wells to prevent said reaction beads from escaping from said wells, and a handgrip connected to the housing frame adjacent to said slot and extending outwardly thereof.

3. A device as claimed in claim 2, wherein the perforated broad wall is formed the plurality of rib members crisscrossing each other to form intersecting portions superimposed with the openings of the reaction wells respectively.

* * * * *